US006729615B2

(12) United States Patent
Luongo et al.

(10) Patent No.: US 6,729,615 B2
(45) Date of Patent: May 4, 2004

(54) SHEET DECURLER IN A SHEET-PROCESSING ROTARY PRINTING PRESS

(75) Inventors: Rocco Luongo, Heidelberg (DE); Christian Hieb, Neuhofen (DE)

(73) Assignee: Heidleberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/372,986

(22) Filed: Feb. 24, 2003

(65) Prior Publication Data

US 2003/0160382 A1 Aug. 28, 2003

(30) Foreign Application Priority Data

Feb. 23, 2002 (DE) ..... 102 07 866

(51) Int. Cl.[7] ..... B65H 29/70
(52) U.S. Cl. ..... 271/188; 399/406
(58) Field of Search ..... 271/188; 162/197, 162/271; 399/406

(56) References Cited

U.S. PATENT DOCUMENTS 4,013,284 A * 3/1977 Demetre ..... 271/183
5,036,948 A 8/1991 Henn
2002/0014170 A1 * 2/2002 Hieb ..... 101/232
2002/0164183 A1 * 11/2002 Berlingen et al. ..... 399/406

FOREIGN PATENT DOCUMENTS

DE 39 00 723 C1 12/1989
DE 197 33 692 A1 2/1999
EP 0 726 221 B1 8/1996

* cited by examiner

*Primary Examiner*—Donald P. Walsh
*Assistant Examiner*—Kenneth W Bower
(74) *Attorney, Agent, or Firm*—Laurence A. Greenberg; Werner H. Stemer; Ralph E. Locher

(57) ABSTRACT

A sheet decurler for smoothing sheets in a sheet-processing rotary printing press includes a suction chamber provided with a connection for connecting the suction chamber to a suction source, and a smoothing notch communicating with the chamber. The smoothing notch is disposed in such a way that sheets are drawable thereover. The suction chamber is constructed as a sound muffler or silencer.

8 Claims, 4 Drawing Sheets

SHEET DECURLER IN A SHEET-PROCESSING ROTARY PRINTING PRESS

BACKGROUND OF THE INVENTION

Field of the Invention

The invention relates to a sheet decurler or smoothing device provided in a sheet-processing rotary printing press for smoothing sheets. The sheet decurler includes a suction chamber having a suction connection, and a smoothing notch communicating with the suction chamber. The sheets are to be drawn over the smoothing notch.

Sheets processed by rotary printing presses, in particular after processing thereof in a recto printing process, generally exhibit a certain amount of curvature in the processing direction, which is often particularly pronounced at the trailing end of the sheets. Since that is already disadvantageous for the formation of a sheet pile or stack with accurately aligned edges and, moreover, for subsequent processing steps, heretofore-known rotary printing presses are equipped in particular with decurling or smoothing devices. Corresponding smoothing devices are installed in sheet guide surfaces of deliveries in such printing presses, and generally include a suction chamber provided with a suction connection, and a smoothing notch communicating with the suction chamber.

The processed sheets are drawn over the smoothing notch with the unprinted side of the sheets facing the smoothing notch, so that during operation, i.e., when a vacuum is formed in the suction chamber, a crease or bead is formed in the respective sheets and projects into the smoothing notch, thereby reversing the curvature formed in the respective sheets.

A decurling or smoothing device of that general type is disclosed in German Published, Non-prosecuted Patent Application DE 197 33 692 A1, for example, and is configured in such a way that the vacuum in the suction chamber does not dissipate abruptly when a respective sheet leaves the smoothing notch formed there as a suction gap. For that purpose, the suction chamber including the suction gap is provided with suction openings upstream of the suction gap with regard to the processing direction. The openings are formed and disposed in such a way that, as the trailing edge of a respective sheet increasingly approaches the suction gap, the openings draw more and more leakage air. As a result, only low suction forces continue to act upon the trailing region of a respective sheet drawn over the smoothing notch, so that the result is a quiet sheet run without any turning up of the sheet trailing edge leaving the smoothing notch.

A sheet decurling or smoothing device constructed in that manner is therefore also distinguished by reduced noise development and is suitable, in particular, for decurling moderately deformed and/or flexible sheets. In particular, it is possible to gather from heretofore-known sheet decurlers or smoothing devices the teaching that noise development therefrom may be reduced by avoiding abrupt dissipation of the vacuum of the suction chamber.

SUMMARY OF THE INVENTION

It is accordingly an object of the invention to provide a sheet decurler or smoothing device for a sheet-processing rotary printing press, which overcomes the hereinafore-mentioned disadvantages of the heretofore-known devices of this general type and in which even greatly deformed and flexurally rigid sheets may be decurled or smoothed with the least possible noise development.

With the foregoing and other objects in view, there is provided, in accordance with the invention, in a sheet-processing rotary printing press, a sheet decurler for smoothing sheets. The sheet decurler comprises a suction chamber having a connection for connecting the suction chamber to a suction source, and a smoothing notch communicating with the suction chamber. The smoothing notch is disposed in such a way that sheets are drawable thereover, and the suction chamber is constructed as a sound muffler.

In accordance with another feature of the invention, the suction-chamber sound muffler is constructed as an impedance sound muffler.

In accordance with a further feature of the invention, the suction chamber forms a returned or reversed flow duct extending transversely to the smoothing notch.

In accordance with an added feature of the invention, the flow duct is formed as a diffusor.

In accordance with an additional feature of the invention, the suction chamber is constructed as a resonance sound muffler.

In accordance with yet another feature of the invention, the sheet decurler further includes a plurality of ducts disposed along the smoothing notch and opening at one end of each thereof into the smoothing notch and at the other end of each thereof into the suction chamber.

In accordance with yet a further feature of the invention, the ducts are formed by hollow profiles projecting into the suction chamber.

In accordance with a concomitant feature of the invention, the suction chamber has a sound-absorbing construction.

Thus, in order to achieve the foregoing object or objects, a sheet decurler or smoothing device having a suction chamber with a connection to suction, and a smoothing notch communicating with the chamber, is provided. The suction chamber is constructed as a sound muffler or silencer.

Through the use of this feature, a noise produced in the suction chamber by a sudden collapse of the vacuum therein is damped or muffled immediately at the point of production. This advantageously permits the maintenance of a vacuum which is sufficiently high for achieving a satisfactory decurling result until the trailing edge of a respective sheet drawn over the smoothing device exposes the smoothing notch.

Other features which are considered as characteristic for the invention are set forth in the appended claims.

Although the invention is illustrated and described herein as embodied in a decurler or sheet smoothing device in a sheet-processing rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
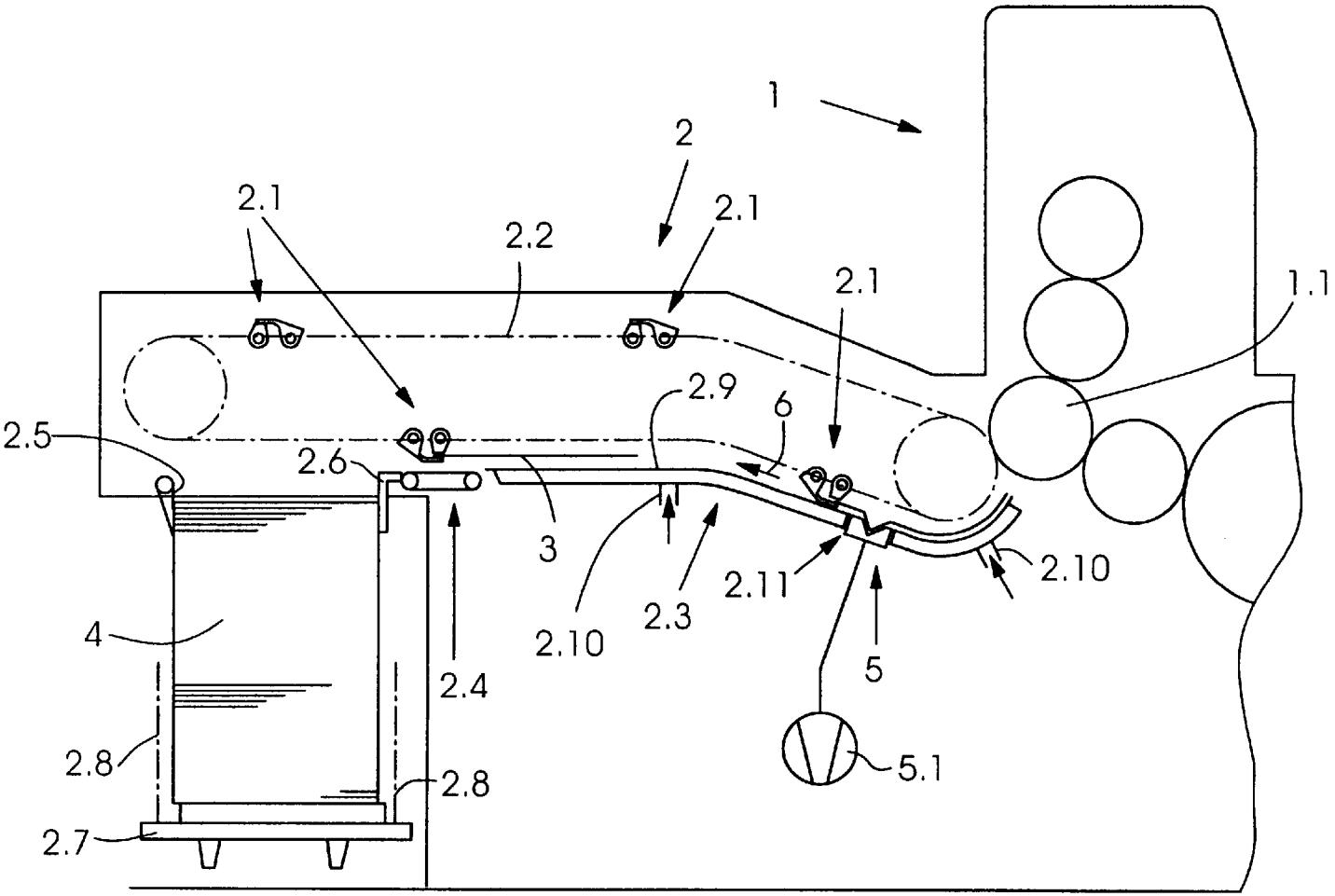
FIG. 1 is a fragmentary, diagrammatic, side-elevational view of an end section of a sheet-processing rotary printing press having a decurler or smoothing device integrated in a delivery of the printing press, for decurling or smoothing the sheets.

Referring now to the figures of the drawings in detail and first, particularly, to FIG. 1 thereof, there is seen a sheet decurler or smoothing device 5 forming a constituent part of a delivery 2 following the last processing station 1 of a rotary printing press. The last processing station 1 may be a printing unit or a finishing unit, such as a varnishing unit. In the example at hand, the last processing station 1 is a printing unit operating in accordance with the offset printing process.

The delivery 2 following the printing unit 1 includes at least one gripper system 2.1 carried by a chain conveyor 2.2 which revolves during operation and is represented here in phantom, i.e., by dot-dash lines. During a revolution of a respective gripper system 2.1, the latter takes over a print carrier in the form of a sheet 3 from an impression cylinder 1.1 guiding the sheet 3, and transports the sheet 3 over a sheet guiding device 2.3 to a sheet brake 2.4. The latter picks up the sheet 3 as it is released by the respective gripper system 2.1, brakes it to a deposition speed and, in turn, finally releases it, so that it strikes against leading-edge or front stops 2.5 at this deposition speed, while falling simultaneously, and being aligned at the front stops 2.5 and at trailing-edge stops 2.6 located opposite to the front stops 2.5, together with preceding and/or following sheets 3, and therewith forms a sheet pile or stack 4 carried by a lifting mechanism which lowers the sheet pile 4 to an extent conforming with an increasing height thereof.

The lifting mechanism is represented in FIG. 1 only by a platform 2.7 bearing the sheet pile 4, and lifting chains 2.8 bearing the platform 2.7, the lifting chains 2.8 being reproduced in phantom, i.e., by dot-dash lines.

On the sheet guiding device 2.3, there is formed a sheet guiding surface 2.9 which follows the path of the gripper system 2.1 guided thereover and which, in order to guide sheets printed on both sides, is fitted with nozzles, not illustrated here, to produce an air cushion between the sheet guiding surface 2.9 and the sheet 3 guided over the latter, the nozzles being fed by an air supply system which is represented in FIG. 1 by a connecting piece 2.10.

In the sheet guiding surface 2.9, which preferably extends somewhat continuously in order to guide sheets printed on both sides thereof, a gap 2.11 is provided in the sheet guiding device 2.3 for the insertion of the sheet decurler or smoothing device 5, the gap 2.11 being closed by the sheet decurler or smoothing device 5.

A respective sheet carried by the impression cylinder 1.1 is gripped by a gripper system 2.1 in a gripper edge region which adjoins an edge of the respective sheet 3 leading with respect to the sheet travel direction represented by the arrow 6, and therefore runs through the delivery 2 with positive guidance of this leading edge along a conveying path that includes the decurler or sheet smoothing device 5, transfer of the sheet 3 to the sheet brake 2.4 taking place at the end of the conveying path.

The decurler or smoothing device 5 includes a suction chamber connected to a vacuum generator 5.1 and is constructed as a muffler or silencer, which is discussed hereinafter in greater detail.

Regardless of the principle upon which the muffling or silencing is performed, the common factor in appropriately constructed decurling and smoothing devices is that they extend transversely with respect to the travel direction of the sheet 3, have a smoothing notch which likewise extends transversely with respect to the sheet travel direction and have a length which is at least equal to the corresponding extent of sheets 3 with the maximum format that can be processed, and that they have a suction chamber which communicates with the smoothing notch over which the sheets are drawn.

Figure 2:
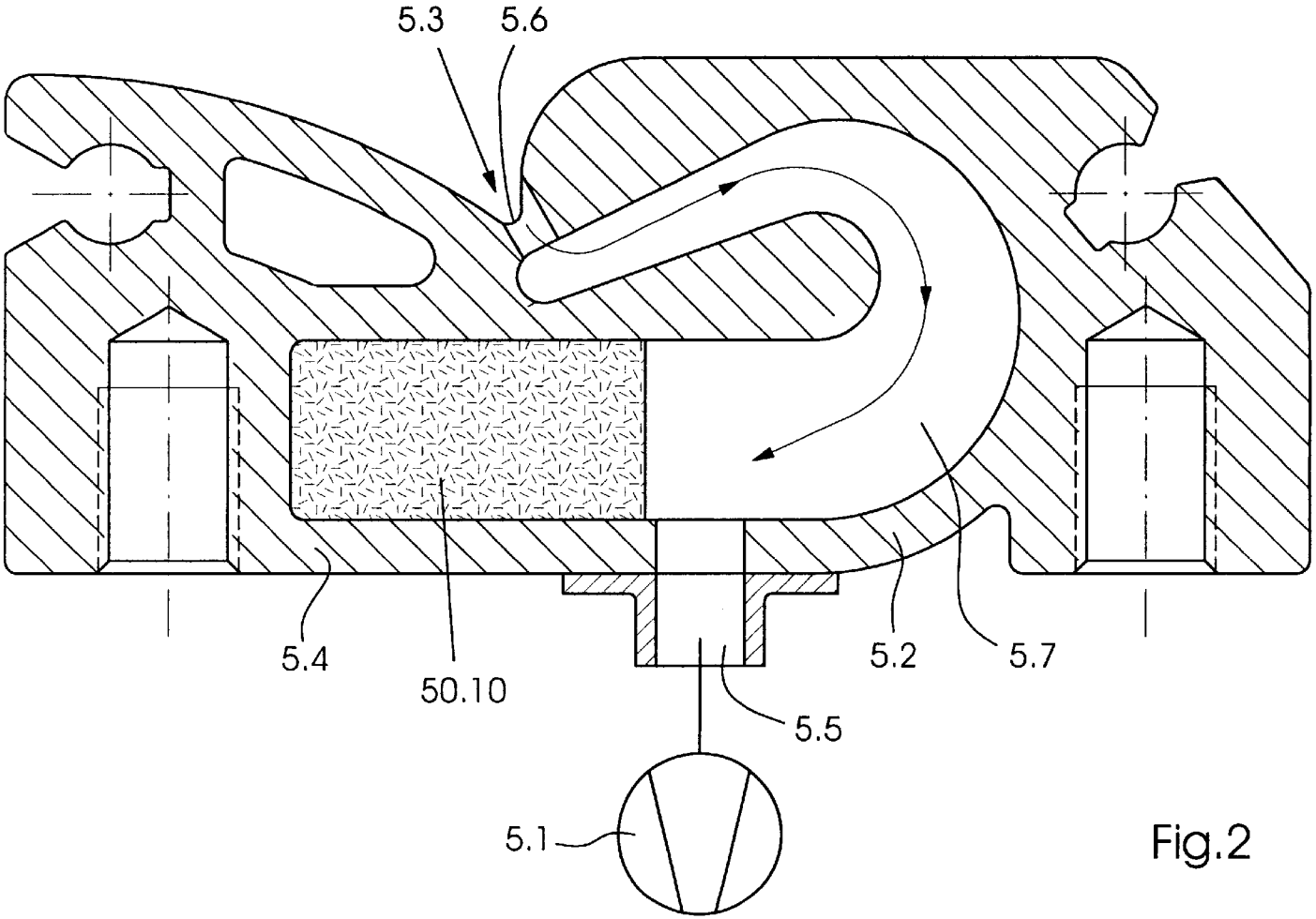
FIG. 2 is an enlarged, fragmentary, cross-sectional view of FIG. 1, showing a first embodiment of a suction chamber of the decurler, which is formed as an impedance attenuator or damper.

In FIG. 2, there is shown an exemplary embodiment of the sheet decurling or smoothing device 5 in a cross-sectional view, the plane of cross section extending in the travel direction of the sheets 3 and perpendicularly to the sheet guiding surface 2.9. In this view, therefore, there is shown, in particular, the cross section of a suction chamber 5.2 which is provided in accordance with the exemplary embodiment and which communicates with a smoothing notch 5.3. In this regard, the suction chamber 5.2 constitutes an interior space of a hollow profile 5.4, whereon, respectively, at the ends thereof, a closure, otherwise not specifically illustrated, is provided so that, besides a connection 5.5 to a suction source, namely the vacuum generator 5.1, and suction openings 5.6 communicating with the smoothing notch 5.3, a closed suction-chamber interior space 5.7 is produced.

In the embodiment of FIG. 2, the suction chamber 5.2 forms a returned or reversed flow duct extending transversely to the smoothing notch 5.3, and, therefore, having the configuration of an impedance muffler or silencer, wherein the muffling or damping property thereof is produced by flow reversal or return or deflection. The extent of the deflection or reversal in the configuration according to FIG. 2 is about 210 degrees. With flow deflections of this type, an attenuation of up to 3 dB can be attained.

In a preferred embodiment, the reversed or deflected flow duct is constructed as a diffusor. A result thereof, in a rather simple manner, is an additional advantage of a low flow resistance of the flow duct.

Figure 3:
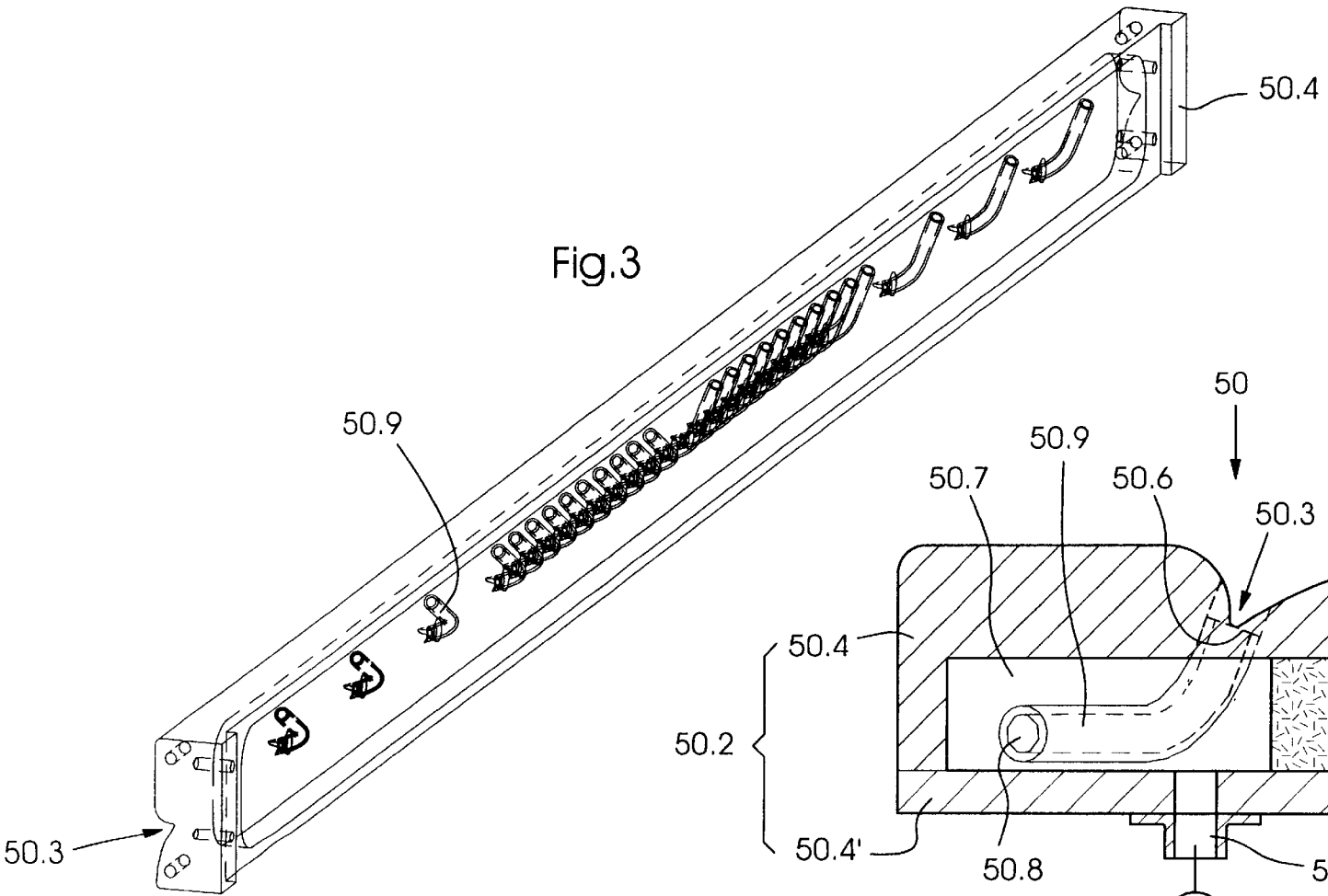
FIG. 3 is a perspective view of a second embodiment of the suction chamber, which can be closed by a removed cover plate, and which is formed as an impedance attenuator or damper.
Figure 4:
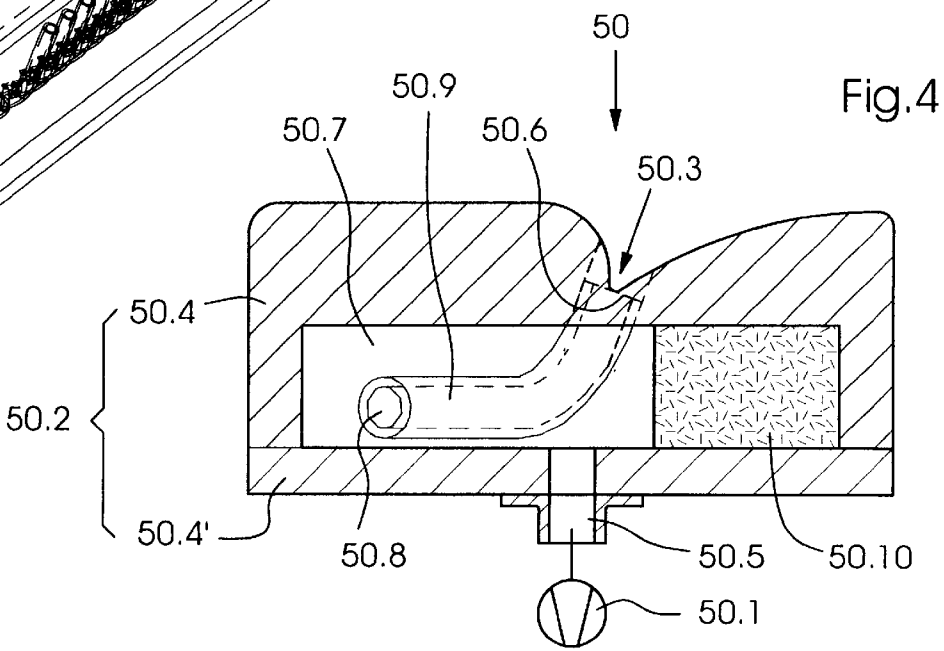
FIG. 4 is an enlarged, cross-sectional view of FIG. 3, showing the suction chamber with the cover plate therefor.

For sound muffling or attenuation that is improved over that for the configuration of the invention according to FIG. 2, a smoothing device 50 in the form of an impedance sound muffler is provided in another embodiment constructed as a resonance muffler which, in an exemplary configuration according to FIGS. 3 and 4, includes a suction chamber 50.2 made up of a trough 50.4 and a closure plate 50.4' closing the trough 50.4. The side of the trough 50.4 formed with the smoothing notch 50.3, when in proper use, faces towards the respective sheets 3 to be decurled or smoothed. The trough 50.4 and the closure plate 50.4', in turn, enclose an interior space 50.7 of the suction chamber 50.2, which communicates on one side thereof, via a suction connection 50.5, to a vacuum generator 50.1 and, on the other side thereof, via a suction opening 50.6, with the smoothing notch 50.3.

Ducts 50.8 disposed along the smoothing notch 50.3 terminate in or open into the suction chamber 50.2, more precisely into the interior space 50.7 of the suction chamber 50.2 and, in turn, have suction openings 50.6 terminating at or opening into the smoothing notch 50.3. The ducts 50.8 typically have a length that is greater than the inner diameter thereof. In a non-illustrated embodiment, this may be implemented, for example, by a relatively great wall thickness of the bottom of the trough 50.4 in the vicinity of the smoothing notch 50.3 and by through-holes or apertures of another contour, for example a slot-like contour, provided at the location of this greater wall thickness and communicating with the smoothing notch 50.3.

In a configuration deviating from the foregoing configuration, the ducts 50.8 are formed by hollow profiles 50.9, as can be seen in FIGS. 3 and 4. In the exemplary embodiment of FIGS. 3 and 4, the hollow profiles 50.9 are formed as small tubes which are inserted through holes into the bottom of the trough (shown at the top of FIG. 4), and disposed in the vicinity of the bottom of the smoothing notch 50.3, so that the tubes 50.9 project into the interior space 50.7 of the suction chamber 50.2. Accordingly, a resonance noise muffler having a natural resonance depending upon the geometry thereof is formed thereby.

Figure 5:
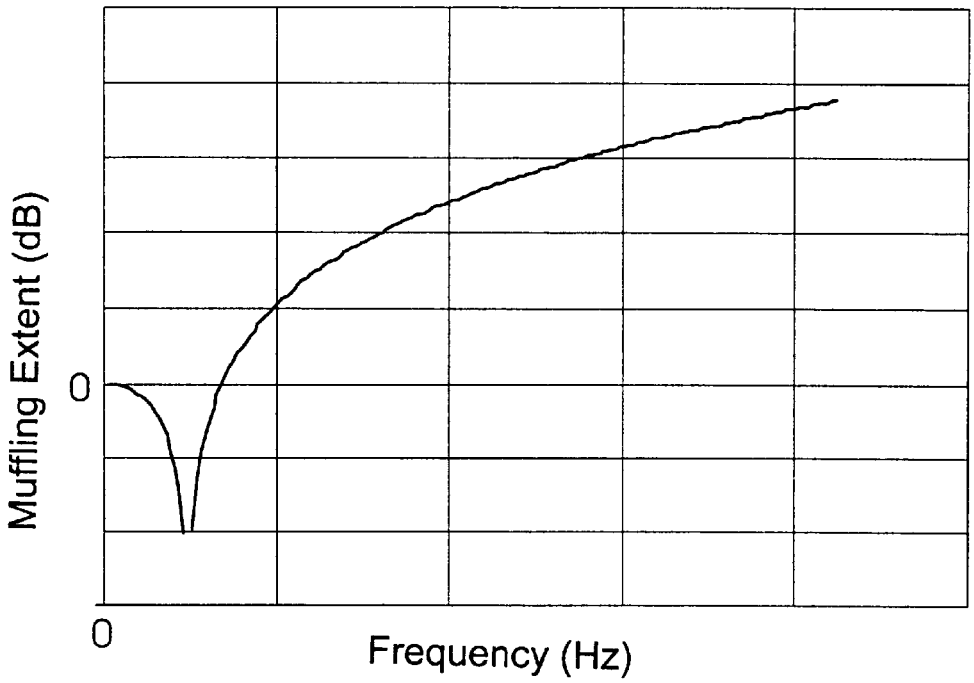
FIG. 5 is a plot diagram showing, in qualitative terms, a typical relationship for a resonance sound muffler or damper between extent or level of attenuation in decibels and frequency of sound in cycles per second.

In FIGS. 3 and 4, without any claim for quantitative reproduction, an example of an appropriate geometry is indicated which causes a natural resonance at a relatively low frequency, so that the smoothing device is constituted as an acoustic low-pass filter which in fact, as is represented in FIG. 5 without any claim to quantitative reproduction, radiates the sound in a frequency range including the natural resonance frequency and the frequency immediately adjacent thereto in undamped and amplified form, respectively, but increasingly attenuates the sound in the range of the remaining frequency band, as the frequency increases.

In a further embodiment of the invention, the suction chamber 50.2 is constructed for absorbing sound. For this purpose, for example, the suction chamber 50.2 is at least partially lined with a sound-absorbing material 50.10. In this way, additional muffling may be achieved, which then acts upon the noise which is radiated at and near the natural frequency of the smoothing device.

A corresponding sound-absorbing lining is preferably also provided for a configuration of the smoothing device such as that which is illustrated in FIG. 2.

We claim:

1. In a sheet-processing rotary printing press, a sheet decurler for smoothing sheets, comprising:

a suction chamber constructed as a sound muffler, said suction chamber having a connection for connecting said suction chamber to a suction source; and a smoothing notch communicating with said suction chamber, said smoothing notch being disposed for having sheets drawn over said smoothing notch.

2. The sheet decurler according to claim 1, wherein said suction-chamber sound muffler is constructed as an impedance sound muffler.

3. The sheet decurler according to claim 2, wherein said suction chamber forms a returned or reversed flow duct extending transversely to said smoothing notch.

4. The sheet decurler according to claim 3, wherein said flow duct is formed as a diffusor.

5. The sheet decurler according to claim 2, wherein said suction chamber is constructed as a resonance sound muffler.

6. The sheet decurler according to claim 5, further comprising a plurality of ducts disposed along said smoothing notch and each having one end opening into said smoothing notch and another end opening into said suction chamber.

7. The sheet decurler according to claim 6, wherein said ducts are formed by hollow profiles projecting into said suction chamber.

8. The sheet decurler according to claim 1, wherein said suction chamber has a sound-absorbing construction.

* * * * *

UNITED STATES PATENT AND TRADEMARK OFFICE

CERTIFICATE OF CORRECTION

PATENT NO. : 6,729,615 B2
DATED : May 4, 2004
INVENTOR(S) : Rocco Luongo et al.

It is certified that error appears in the above-identified patent and that said Letters Patent is hereby corrected as shown below:

Title page,
Item [73], Assignee, should read as follows:
-- Heidelberger Druckmaschinen AG, Heidelberg (DE) --

Signed and Sealed this

Seventeenth Day of August, 2004

JON W. DUDAS
*Acting Director of the United States Patent and Trademark Office*